US006119845A

United States Patent [19]

Song

[11] Patent Number: 6,119,845

[45] Date of Patent: Sep. 19, 2000

[54] PASSENGER CONVEYER

[75] Inventor: Kee Hyo Song, Changwon, Rep. of Korea

[73] Assignee: LG Industrial Systems Co., Ltd., Seoul, Rep. of Korea

[21] Appl. No.: 09/260,517

[22] Filed: Mar. 2, 1999

[30] Foreign Application Priority Data

Mar. 2, 1998 [KR] Rep. of Korea ..... 98-6773

[51] Int. Cl.[7] ..... B66B 23/06

[52] U.S. Cl. ..... 198/331; 198/335

[58] Field of Search ..... 198/330, 331, 198/335

[56] References Cited

U.S. PATENT DOCUMENTS

| | | | |
|---|---|---|---|
| 2,253,386 | 8/1941 | McCormick | 198/331 |
| 3,414,109 | 12/1968 | Clark | 198/335 |
| 5,125,494 | 6/1992 | Nurnberg et al. | 198/330 X |
| 5,372,232 | 12/1994 | Aris et al. | 198/335 |
| 5,566,810 | 10/1996 | Meyer et al. | 198/331 |

*Primary Examiner*—James R. Bidwell

[57] ABSTRACT

Present invention relates to a hand rail driving pulley for a passenger conveyor. According to the invention, when difference between the moving velocity of a step and the moving velocity of a hand rail generates, by adjusting the radius of the driving pulley, the velocity difference can be synchronized without any change of new part. And present invention discloses a new installing method of elastic contacting ring inserted into a groove not the conventional adhering method, so when a worn contacting ring is changed, changing work can be done easily and simply.

23 Claims, 11 Drawing Sheets

PASSENGER CONVEYER

BACKGROUND OF THE INVENTION

1. Field of the Invention

The present invention relates to a passenger conveyer, and in particular to a driving pulley which drives a hand rail and more particular to a driving pulley which is capable of controlling a moving speed of a hand rail.

2. Description of Related Art

Generally, a passenger conveyer is installed in an airport, subway, building, etc. and is an apparatus for effectively conveying passengers from a position to another position. As examples of a passenger conveyer, an escalator is known for conveying passengers from one position to another position at a different height, or a moving walkway for conveying passengers horizontally from one position to another position.

The above-described passenger conveyer includes a plurality of steps on which a passenger steps, a pair of balustrades each of which are installed uprightly and continuously near each side of the steps from a boarding position to a taking-off position, hand rails movably installed on the balustrade and moving along a predetermined loop, and a driving apparatus for driving the steps and the hand rails.

The conventional passenger conveyer will be explained with reference to the escalator.

First, FIG. 1 is a schematic lateral cross-sectional view illustrating a conventional escalator. As shown therein, reference numeral 11 represents a plurality of steps 11 on which passengers stand. The steps 11 are connected with a step chain 44 and move along a predetermined loop depending on a driving operation of the step chain 44. The connection of the steps 11 and the step chain 44 will be explained in more detail with reference to FIGS. 2A and 2B.

A pair of balustrades 21 are installed uprightly and continuously near side edges of the steps, from the boarding position of the passengers to the stepping-off position of the passengers for providing a lateral boundary of the passenger conveyor. A hand rail guide(not shown) is fixedly installed at each upper surface of the balustrades 21.

The hand rail 20 is guided by the hand rail guide and surrounds the balustrades 21. Reference numeral 32A is a transmission output sprocket connected with an output shaft of the transmission which increase the rotation driving torque of a driving motor(not shown). The transmission output sprocket 32A, and the connection and driving force transfer structure of the transmission and the motor will be explained with reference to FIGS. 3A and 3B.

The transmission output sprocket 32A is driven by a pair of step driving sprockets 42*a* and 42*b* via driving chain 33.

The step driving sprockets 42*a* and 42*b* are connected with pair of step driven sprockets 46*a* and 46*b* installed below the lower balustrades 21 of the escalator. The step driving sprockets 42*a* and 42*b* are drivingly connected with a hand rail driving pulley 60 through a driving force transfer chain(not shown).

A part of the loop of the hand rail 20 is wound on the driving pulley 60 and is moved by the rotation of the hand rail driving pulley 60.

The operation of the conventional escalator will be explained.

When rotating the motor shaft by supplying power to the motor, the transmission connected with the output shaft of the motor increases or decreases the driving torque of the motor by using the gears installed therein. The transmission output sprocket 32A connected with the output shaft of the transmission is rotated, and the rotation force of the transmission sprocket 32A is transferred to the step driving sprockets 42*a* and 42*b* through the driving chain 33. Therefore, the step driving sprockets 42*a* and 42*b* are rotated, and the step chain 44 and the step driven sprockets 46*a* and 46*b* connected with the step driving sprockets 42*a* and 42*b* are rotated. The steps 11 connected with the step chain 44 are moved upwardly or downwardly. Since the hand rail driving pulley 60 is connected with the step driving sprockets 42*a* and 42*b*, when the step driving sprockets 42*a* and 42*b* are rotated, the hand rail driving pulley 60 is rotated thereby moving the hand rail 20. As a result, when passenger boards on the step 11, the passenger is conveyed upwardly or downwardly with his hands holding the hand rail 20.

FIGS. 2A and 2B are front and lateral views illustrating a connection between the step 11 and the step chain 44.

As shown therein, the step 11 includes a pair of horizontally extending front wheel roller rotation shafts 11*c* passing through the step chain 44 from a predetermined position of the upper sides of the step 11, and a pair of horizontally extending rear wheel roller rotation shafts 11*d* from lower sides of the step.

A pair of front wheel rollers 11*a* are rotatably installed on the front wheel roller rotation shafts 11*c*, and a pair of rear wheel rollers 11*b* are rotatably installed on the rear wheel roller rotation shafts 11*d*. Therefore, when the step chain 44 rotates, since the front wheel roller rotation shafts 11*c* are connected with the step chain 44, the step 11 moves in the same direction as the step chain 44.

FIG. 3A is a schematic perspective view illustrating a step and a driving unit which drives the step, and FIG. 3B is a plan view illustrating a driving connection relationship between a driving unit and a hand rail driving unit of FIG. 3A.

As shown therein, the motor 31 is connected with the transmission 32. A plurality of transmission gears(not shown) of transmission 32 are connected with an output shaft of the motor 31, so that the rotation torque from the output shaft of the motor 31 is increased and the rotation velocity of the output shaft is decreased.

The transmission output sprocket 32*a* is connected with an output of the transmission 32 and is rotated by the rotation torque from the transmission 32.

The main sprocket 43 is drivingly connected with the transmission output sprocket 32*a* through the driving chain 33.

Therefore, when the transmission output sprocket 32*a* is rotated, rotation torque is transferred to the main sprocket 43 through the driving chain 33 for rotating the main sprocket 43. The main sprocket 43, the step driving sprockets 42*a* and 42*b* and one hand rail driving sprocket 52 are coaxially connected with the main driving shaft 41, so that they are all rotated together with the main driving shaft 41. The main driving shaft 41 is supported by a support and rotates as the main sprocket 43 rotates. The hand rail driving sprocket 52 is drivingly connected with the hand rail driven sprocket 53 through the hand rail chain 54. Therefore, when the hand rail driving sprocket 52 is rotated, the rotation torque is transferred to the hand rail driven sprocket 53. The hand rail driven sprocket 53 is rotatably engaged to the hand rail driving shaft 51, and a pair of hand rail driving pulleys 60 are coaxially engaged to the hand rail driving shaft 51.

Therefore, when the motor 31 is rotated, the rotation torque of the motor is increased or decreased by the transmission for rotating the transmission output sprocket 32*a*. The rotation torque of the transmission output sprocket 32*a* is transferred to the main sprocket 43 through the driving chain 33 for rotating the main sprocket 43. The rotation torque of the main sprocket 43 is transferred to a pair of the step driving sprockets 42*a* and 42*b* and one hand rail driving sprocket 52 through the main driving shaft 41.

Therefore, as the step chain 44 rotates, the step 11 is moved upwardly or downwardly, so that passengers are moved to a predetermined floor or destination. When the hand rail driving sprocket 52 is rotated, the rotation torque is transferred to the hand rail driven sprocket 53 through the hand rail chain 54 for rotating the hand rail driven sprocket 53.

Therefore, the hand rail driving pulleys 60 coaxially connected with the hand rail driven sprocket 53 and the hand rail driving shaft 51 are rotated thereby rotating the hand rail 20.

The driving connection relationship between the hand rail driving pulley 60 and the hand rail 20 will be explained in detail with reference to FIG. 4.

The transmission output sprocket 32*a* is drivingly connected with the main sprocket 43 through the driving chain 33. The hand rail driving sprocket 52 is coaxially connected with the main sprocket 43. The hand rail driving sprocket 52 is drivingly connected with the hand rail driven sprocket 53 through the hand rail chain 54. A first tension compensating roller 54*a* is installed at an upper location between the hand rail driving sprocket 52 and the hand rail driven sprocket 53 for compensating the tension of the hand rail chain 54. As a result, the hand rail chain 54, which receives a driving force from the hand rail driving sprocket 52 moves to the hand rail driven sprocket 53 through the tension compensating roller 54*a* in a state that the tension is tightly compensated. The second tension compensating roller 20*a* is installed at a location between the hand rail driving pulley 60 and the balustrades 21 for tightly compensating the tension of the hand rail 20. Reference numerals 62*a* and 62*b* represent pressure belt rollers which support the pressure belt 63 which is installed to contact the hand rail 20 below the hand rail driving pulley 60 so as to increase a friction force between the hand rail driving pulley 60 and the hand rail 20. Therefore, the rotation torque from the transmission output sprocket 32*a* is transferred to the main sprocket 43 through the driving chain 33, so that when the main sprocket 43 is rotated, the hand rail driving sprocket 52 coaxially connected with the main sprocket 43 is rotated. The rotation torque of the hand rail driving sprocket 52 is transferred to the hand rail driven sprocket 53 through the hand rail chain 54 in a state that the tension is compensated by the first tension force control roller 54*a*. When the hand rail driven sprocket 53 is rotated, the driving pulley 60 coaxially connected with the sprocket 53 is rotated therefore, the hand rail 20 closely contacts with the driving pulley 60 by a pressure of the pressurizing belt 63 and rotates along the balustrades 21 by a friction force with the driving pulley 60.

The construction and operation of the conventional hand rail driving pulley unit, hand rail and pressurizing belt will be explained with reference to FIGS. 5A and 5B.

The conventional hand rail driving pulley unit includes a hand rail driving shaft 51. A boss portion 60*a* has a through hole into which the hand rail driving shaft 51 is inserted. A spoke member 60 has three spoke portions 60*b* extending radially extended from the boss portion 60*a*. A main wheel 66 has a flange portion 66. Three support members 64, (namely, engaging members), engage for engaging the main wheel 66 and the spoke members 60. A bolt 65*a* supports the head portion to the support member 64 and passes through the main wheel 66 and the spoke member 60. A nut 65*b* is engaged with the threaded portion of the bolt inserted through the main wheel 66 and the spoke member 60. A ring-shaped elastic friction member 61 is adhered on the outer circumferential surface of the main wheel 66.

As shown in FIG. 5A, the main wheel 66 is ring-shaped, and as shown in FIG. 5B, the lateral cross-section of the same is L-shaped. The main wheel 66 includes three bolt insertion holes each of which formed at about an angle of 120 degrees so that the bolts 65*a* are inserted thereinto. The main wheel 66 is preferably made of a metallic material having a good mechanical strength. The support member 64 is used in order to increase the mechanical durability of the main wheel 66 which may be decreased because of the holes of the bolt insertion holes after the spoke member 60 is connected with the main wheel 66 using the bolt 60*a* and the nut 60*b*. The spoke member 60 is used for drivingly coupling the hand rail driving shaft 51 to the main wheel 66. One hole in which the bolt 60*a* is inserted is formed at a portion contacting the main wheel 66 among the spokes. Therefore, the bolt which passes through a center hole among three bolts inserted into one support member 64 passes through the main wheel 66 and the spoke member 60. The remaining two bolts only pass through the main wheel 66. The hand rail driving pulley unit frictionally contacts the hand rail 20 for moving the hand rail 20, so that the friction member 61 is formed by winding a band formed of an elastic resin material such as rubber onto an outer circumferential surface of the main wheel 66. The upper surface of the friction member 61 which contacts the outer circumferential surface of the main wheel 66 is flat in order to increase a bonding force with the outer surface of the main wheel 6. In addition, the outer surface of the main wheel 66 is flat in order to implement a full contact with the friction member 61.

The pressure belt 63 is positioned higher than the portion of the friction member 61 in which the belt surface contacts with the hand rail 20 in order to increase the contact area of the hand rail 20 contacting with the friction member 61, so that as shown in FIG. 5A, the pressure belt 63 is downwardly deflected by the hand rail driving pulley unit.

In this state, an elastic restoring force of the upper surface of the pressure belt 63 is applied to upwardly press the hand rail 20 between the pressure belt 63 and the friction member 61. Therefore, the hand rail 20 closely contacts with the friction member 61. The pressure belt 63 is supported by the belt rollers 62*a* and 62*b* which maintain tension in the pressure belt 63. The pressure belt 63 reciprocates between the belt rollers 62*a* and 62*b* by the friction force of the hand rail 20 when the hand rail 20 is moved by the rotation of the friction member 61.

The operation of the conventional hand rail driving pulley unit will be explained.

When the driving force is applied through the hand rail chain 54, and the hand rail driven sprocket 53 is rotated, the spoke member 60*b* drivingly connected with the hand rail driven sprocket 53 through the hand rail driving shaft 51 is rotated.

Therefore, the main wheel 66 connected with the spoke member 60*b* by the engaging member is rotated, and the friction member 61 fixed to the outer surface of the main wheel 66 is rotated. The hand rail 20 is rotated along the frames by the friction with the friction member 61 which is rotated by the pressure from the pressure belt 63.

In the thusly constituted conventional passenger conveyer, it is very important to move the step 11 and the hand rail 20 at a same speed so that safety of the passengers may be protected.

The motor 31, the transmission 32, the driving force transfer driving chain 33, and the main driving shaft 41 are used as a common driving unit for driving the step 11 and the hand rail 20 at the same speed. Furthermore, the diameters of the hand rail driving sprocket 52 and the hand rail driven sprocket 53 are same and the driving operation of the same is implemented by the chain 54. The hand rail 20 is driven by the main wheel 66 which is coaxially connected with the hand rail driven sprocket 53.

By above mentioned construction, the step 11 and the hand rail 20 may be moved at the same speed.

However, the friction member 62 and the hand rail 20 may wear down over time, so the friction force between the friction member 61 and the hand rail 20 decreases. Therefore, a speed difference occurs between the moving speeds of the step 11 and the hand rail 20. In particular, since the circumference of the friction member 61 is very short relative to the entire length of the hand rail 20, wearing down of the friction member 61 may occur quickly compared to wearing down of the hand rail 20. Thus, moving speed difference between the step 11 and the hand rail 20 is mainly due to the wear of the friction member 61.

However, in the conventional passenger conveyer, since the wear of the friction member is not compensated for, in order to compensate for the resultant speed difference, the worn-down friction member 61 must be removed from the main wheel 60 and replaced with a new friction member bonded on an outer surface of the main wheel 60 to compensate the speed difference. In addition, there no other way for overcoming the speed difference problem except for substituting a new hand rail when the old hand rail is worn.

SUMMARY OF THE INVENTION

Accordingly, it is an object of the present invention to provide a passenger conveyer which is capable of compensating for a speed difference between a hand rail and steps without having to replace a friction member or a hand rail.

It is another object of the present invention to provide a passenger conveyer in which a friction member can be quickly replaced.

Therefore, a passenger conveyer including: a motor for generating a driving torque; a transmission for shifting the driving torque from the motor; a driving sprocket drivingly coupled with the transmission and being rotated by the driving torque transferred from the transmission; a driven sprocket rotatable in correspondence with the rotation of the driving sprocket; an endless loop step chain wound onto the driving sprocket and the driven sprocket and being moved between the sprockets by the rotation of the driving sprocket; a plurality of steps drivingly coupled with the step chain and moving along the movement of the step chain; a pair of balustrades for providing a lateral boundary of the passenger conveyor; a pair of endless loop shaped hand rails each of which moves in the same direction as the moving direction of the steps along the balustrade; a hand rail guide member continuously installed on the upper surfaces of the balustrades for providing a guide surface on which the hand rails move; a hand rail driving pulley assembly rotatable in correspondence the rotation of the driving sprocket for providing a driving force to the hand rail by contacting with the hand rail and having an adjustable radius between the rotation center and a surface contacting with the hand rail for adjusting a moving speed of the hand rail; and a driving force transfer member for transferring a rotation force of the driving sprocket to the hand rail driving pulley assembly.

More particularly, a hand rail driving pulley according to the present invention includes: a driving shaft rotating by a rotation force transferred from the driving force transfer member for rotating the hand rail driving pulley assembly; a main wheel rotating by the rotation of the driving shaft, with the driving shaft passing through the center portion of the main wheel; a movable member disposed to be opposite to one surface of the main wheel and being movable between a position which is spaced-apart from the main wheel in an axial direction and a approached position to the main wheel in an axial direction, wherein a groove having a variable width is formed between opposing surfaces of the main wheel and the movable member; an elastic member positioned between the main wheel and the movable member for biasing the movable member away from the main wheel; a clamping mechanism for adjusting the width of the groove and clamping the main wheel, the movable member and the elastic member for maintaining the adjusted width of the groove; and a contacting ring having at least one surface variable in depth which is inserted into the groove depending on the adjusted width and another surface for providing a friction force to the hand rail and to move the hand rail.

According to the present invention, a hand rail driving pulley mechanism may comprise; a driving shaft which rotates by the rotation force transferred from the driving force transfer member, thereby rotating the hand rail driving pulley assembly; a main wheel mounted on the driving shaft and being rotated by the rotation of the driving shaft; a pair of movable members opposing each other, each of which is movable between a position axially spaced-apart from the main wheel in an axial direction and a approached position to the main wheel in an axial direction, wherein a variable width groove is formed between both opposing surfaces of the movable member; a pair of elastic members disposed between the main wheel and the movable members for biasing the movable members to be apart from the main wheel; a clamping mechanism for clamping the main wheel, the movable member and the elastic member for adjusting the width of the groove and maintaining the adjusted state; and a contacting ring having at least one surface variable in depth which is inserted into the groove depending on the adjusted width and another surface for providing a friction force to the hand rail and to move the hand rail.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
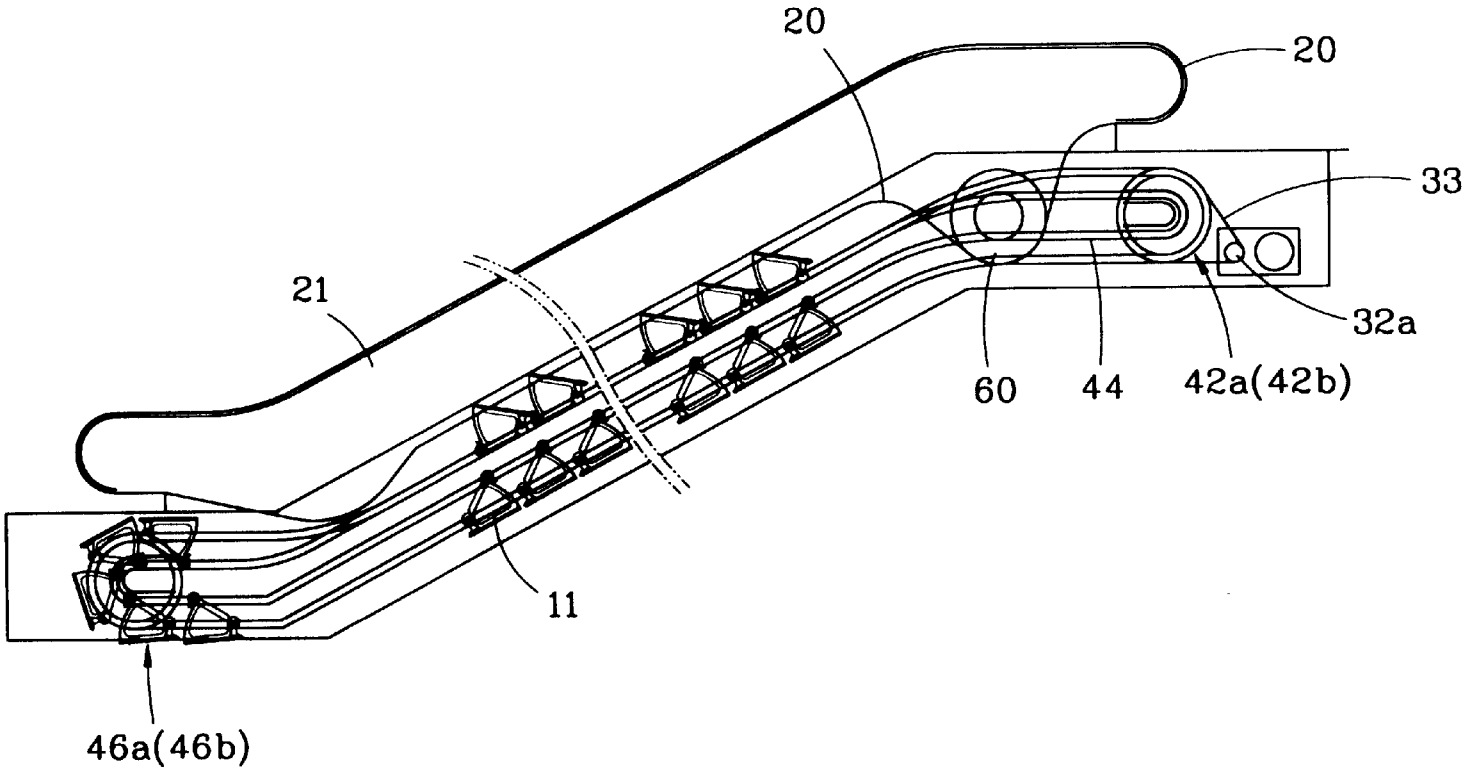
FIG. 1 CONVENTIONAL ART
FIG. 1 is a schematic lateral cross-sectional view illustrating a conventional escalator.
Figure 2A:
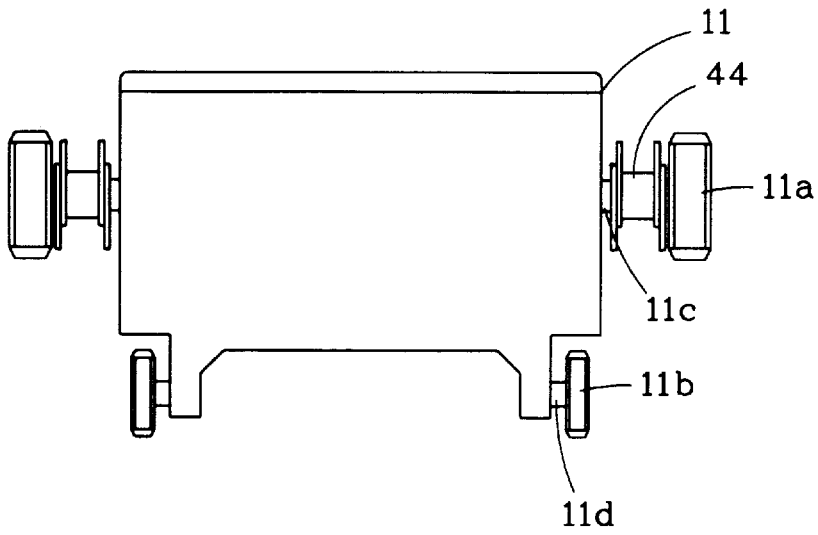
FIG. 2A CONVENTIONAL ART
FIGS. 2A and 2B are front and side views illustrating respectively a connection structure of a step and a step chain.
Figure 2B:
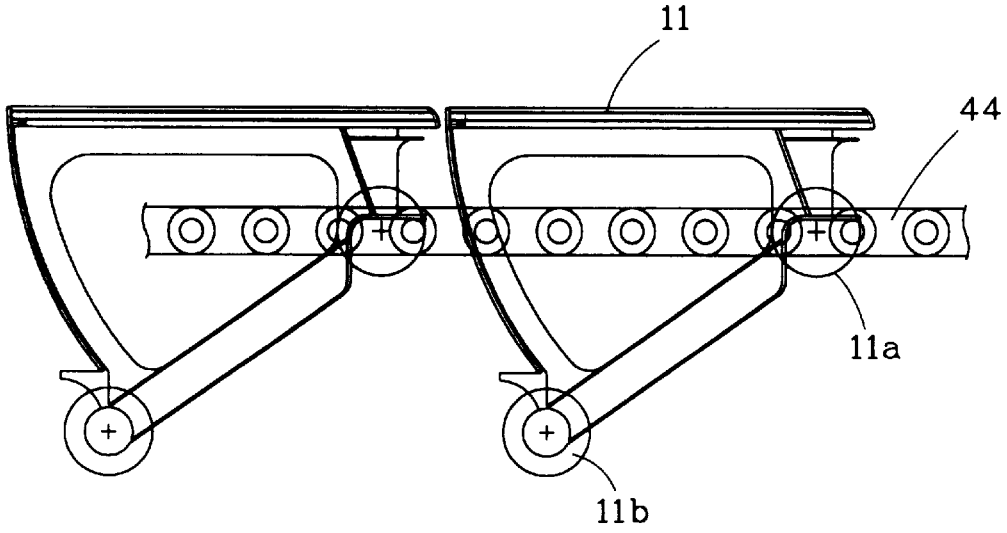
FIG. 2B CONVENTIONAL ART

The embodiments of the present invention will be explained with reference to the accompanying drawings.

The passenger conveyer according to the present invention is similar to the conventional passenger conveyer in their construction and operation except for the hand rail driving pulley unit. Therefore, only the construction and operation of the hand rail driving pulley unit will be explained. The parts and elements which are similar to those in the conventional art will be assigned identical reference numerals and their repeated detailed description will be omitted.

Figure 6A:
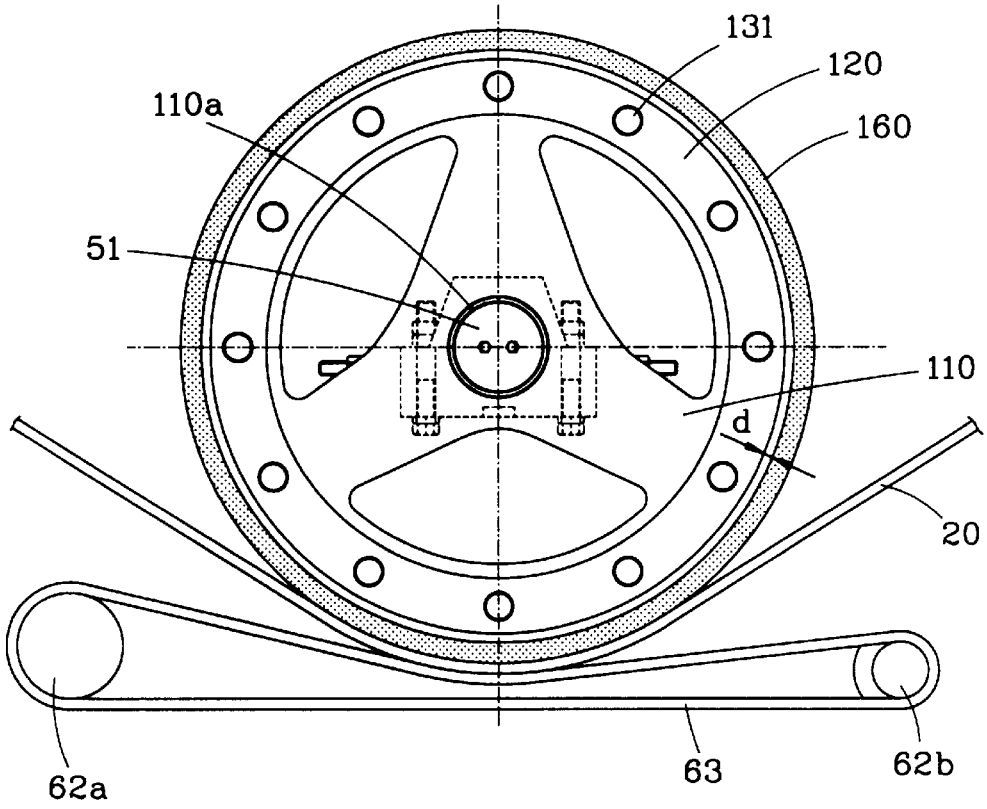
FIG. 6A is a front view illustrating the construction of a hand rail driving pulley unit, hand rail and pressure belt according to the present invention.
Figure 6B:
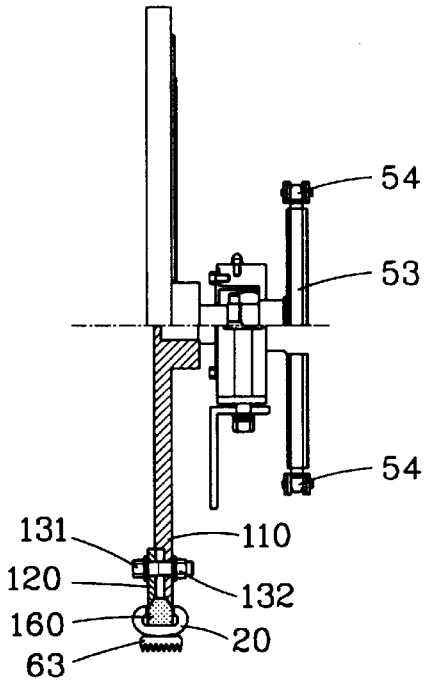
FIG. 6B is a lateral cross-sectional view illustrating a hand rail driving pulley unit according to the present invention.

Referring to FIG. 6A illustrating the construction of a hand rail driving pulley unit, hand rail and pressure belt according to the present invention as a front view and FIG. 6B illustrating a hand rail driving pulley unit according to the present invention as a lateral cross-sectional view, the present invention will be explained as followed.

Figure 3A:
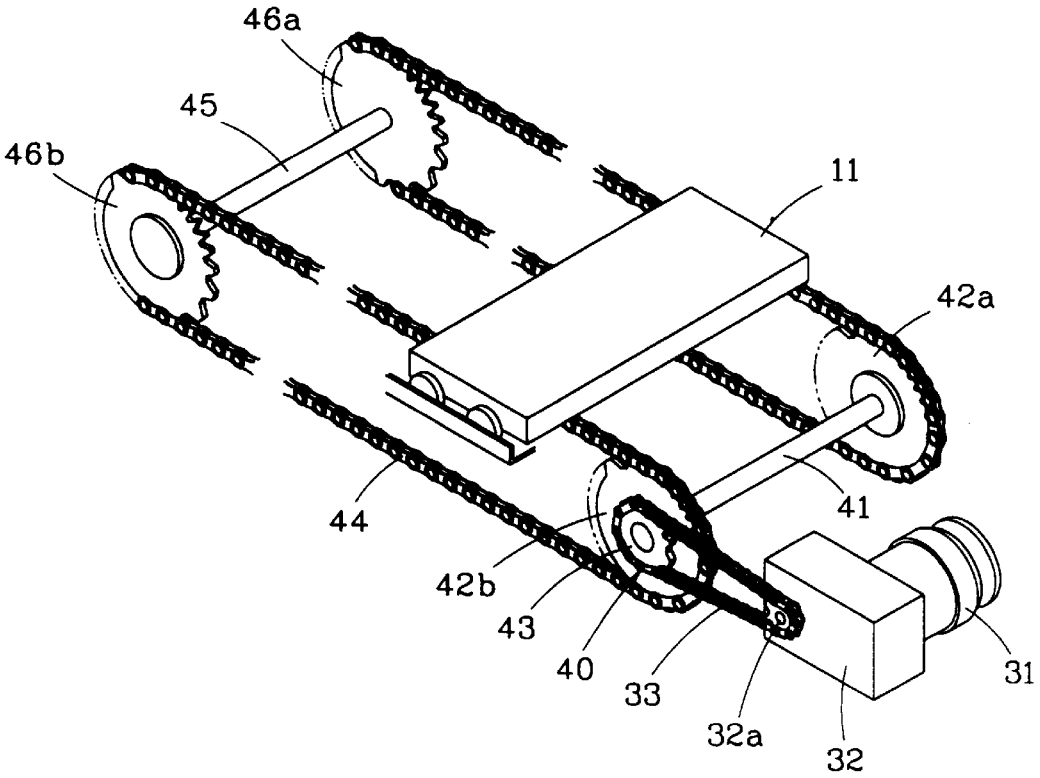
FIG. 3A CONVENTIONAL ART
FIG. 3A is a schematic perspective view illustrating a step and a driving unit which drives the step.
Figure 3B:
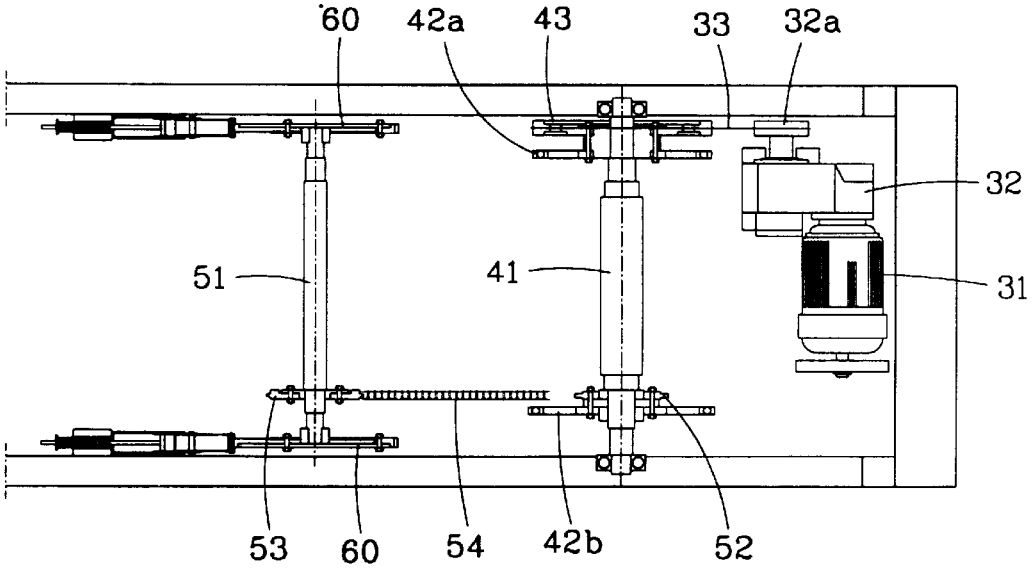
FIG. 3B CONVENTIONAL ART
FIG. 3B is a plan view illustrating a driving connection relationship between a driving unit and a hand rail driving unit of FIG. 3A.
Figure 4:
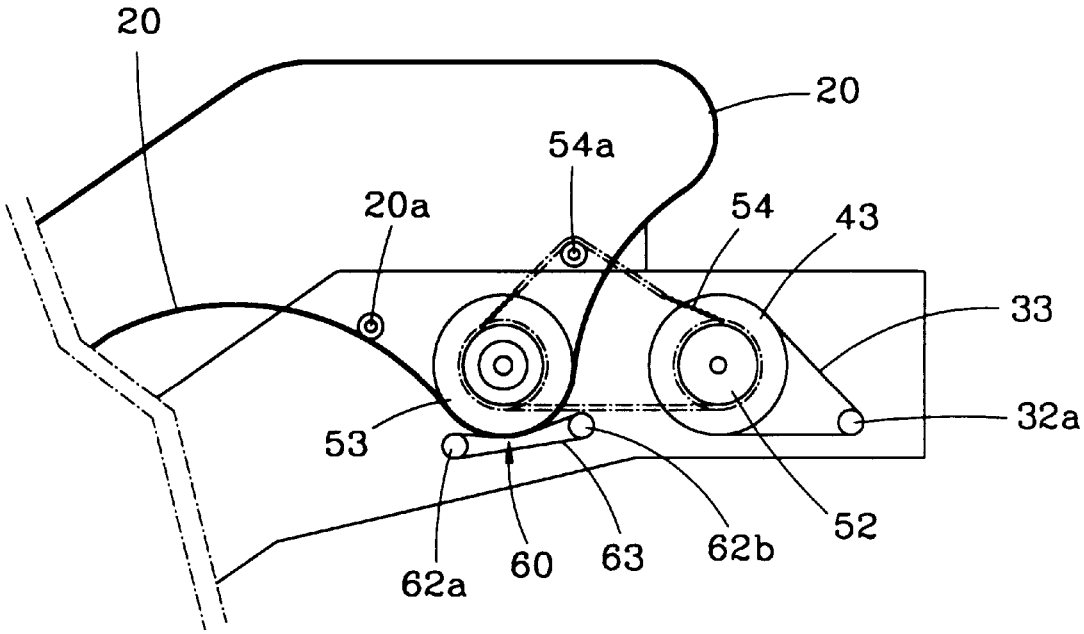
FIG. 4 CONVENTIONAL ART
FIG. 4 is a partial cross-sectional view illustrating a driving connection relationship between a hand rail driving pulley and a hand rail.
Figure 5A:
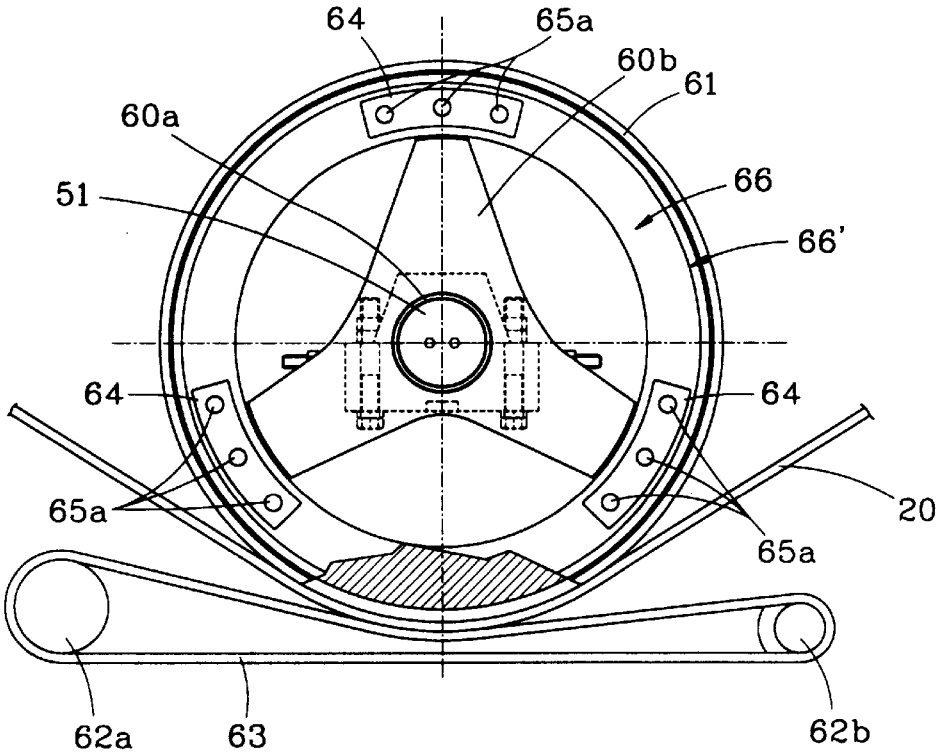
FIG. 5A CONVENTIONAL ART
FIGS. 5A and 5B are front and partial lateral cross-sectional views illustrating the construction of a conventional hand rail driving pulley unit, hand rail and pressure belt.
Figure 5B:
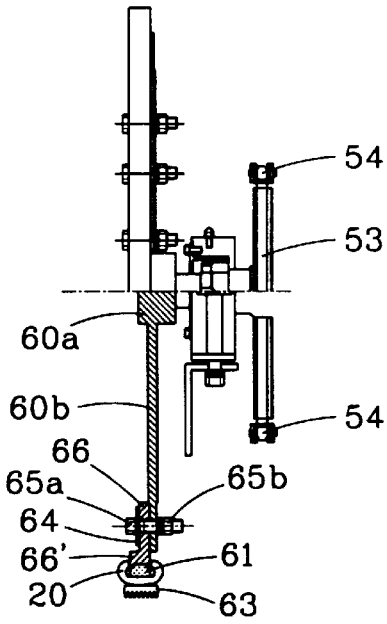
FIG. 5B CONVENTIONAL ART

The hand rail driving pulley unit according to the present invention includes a driving shaft 51 rotated by a rotation torque transferred from a chain 54 of FIG. 3B, which is a torque transferring member for rotating the hand rail driving pulley unit. A main wheel 110 is installed on the driving shaft 51 and is rotated by the driving shaft. A movable member 120 is disposed to be opposite to one surface of the main wheel 110 and is movable between a position which is spaced-apart from the main wheel 110 in an axial direction and proximate to the main wheel 110 in an axial direction. A variable width groove 143 is defined between opposing surfaces of the main wheel 110 and the movable member 120. An elastic member 150 is positioned between the main wheel 110 and the movable member 120 for biasing the movable member away from the main wheel 120. A clamping mechanism 131, 132 is provided for adjusting the width of the groove 143 and clamping the main wheel 110, the movable member 120 and the elastic member 150 to maintain the adjusted width of the groove 143. Finally, a contacting ring having slant surfaces 160*a*, 160*b* variable in depth is inserted into the groove 143 depending on the adjusted width thereof and having another surface 160*c* for providing a friction force to the hand rail to move the hand rail.

Since the construction and operation that the rotation torque is generated for rotating the driving shaft 41 and is transferred to the driving shaft 51 are described in FIG. 3B, the description thereof will not be repeated.

The main wheel 110 includes a boss portion 110*a* for transferring the rotation torque of the driving shaft 51 to the main wheel 11 having a center portion into which the driving shaft 51 is inserted. Three spoke portions 110*b* radially extend from the boss portion 110*a* at about 120 degrees. A ring-shaped flange portion 110*c* integrally connects the extended portions of the spoke portions 110*b*. Therefore, when the driving shaft 51 is rotated, the rotation torque is transferred to the flange portion 110*c* through the boss portion 110*a* and the spoke portions 110*b*, so that the main wheel 110 is rotated together with the driving shaft 51.

The flange portion 110*c* includes one surface stepped from the spoke portions 110*b*. The ring-shaped movable member 120 is axially movable between a position spaced-apart from the surface of the main wheel 110 and a position proximate to the surface of the main wheel 110.

A groove is defined between one surface of the opposite flange portion 110*c* and the movable member 120 along the outer surface of the main wheel 110. A part of the elastic contact ring 160 is inserted into the groove.

The clamping units 131 and 132 include a plurality of bolts 131 and a plurality of nuts 132. The bolt 131 has a threaded portion passing through the flange portion 110*c* and the movable member 120 that is engaged with the nut 132 to thereby clamp the movable member 120 and the main wheel 110. A plurality of clamping units 131 and 132 are installed along the ring-shaped upper surface of the movable member 120 and the flange portion 110*c* at predetermined intervals.

Figure 7:
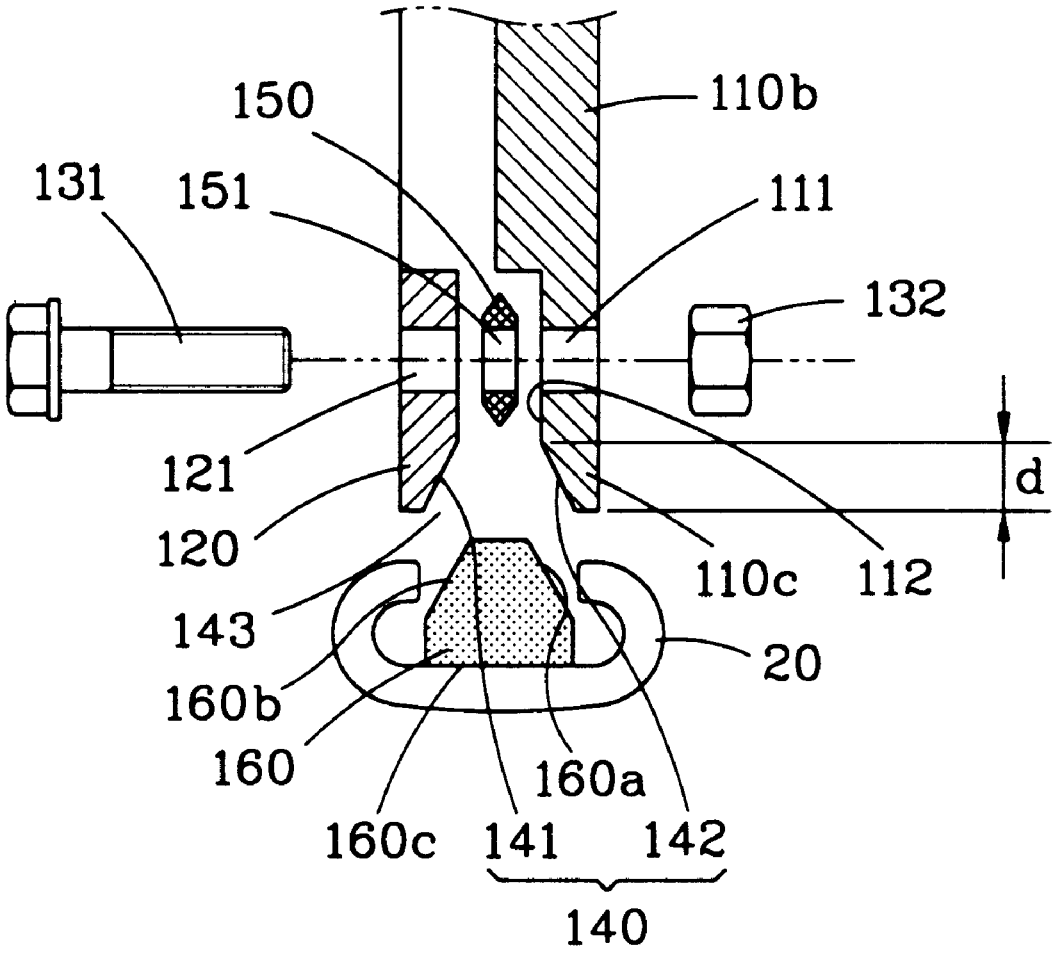
FIG. 7 is an partially enlarged side cross-sectional view of a portion of FIG. 6B with respect to a hand rail driving pulley unit according to the present invention.

The hand rail driving pulley unit according to one embodiment of the present invention illustrated in FIGS. 6A, 6B now will be explained with reference to FIG. 7.

The surface of the flange portion 110*c* of the main wheel 110 opposite to the movable member 120 includes plane surface 112 and slant surface 142. The movable member 120 includes plane surface 122 and the slant surface 141 which are opposite to plane surface 112 and slant surface 142 of the main wheel 110.

An elastic member 150 is installed between plane surface 112 of the main wheel 110 and plane surface 122 of the movable member 120.

Figure 11:
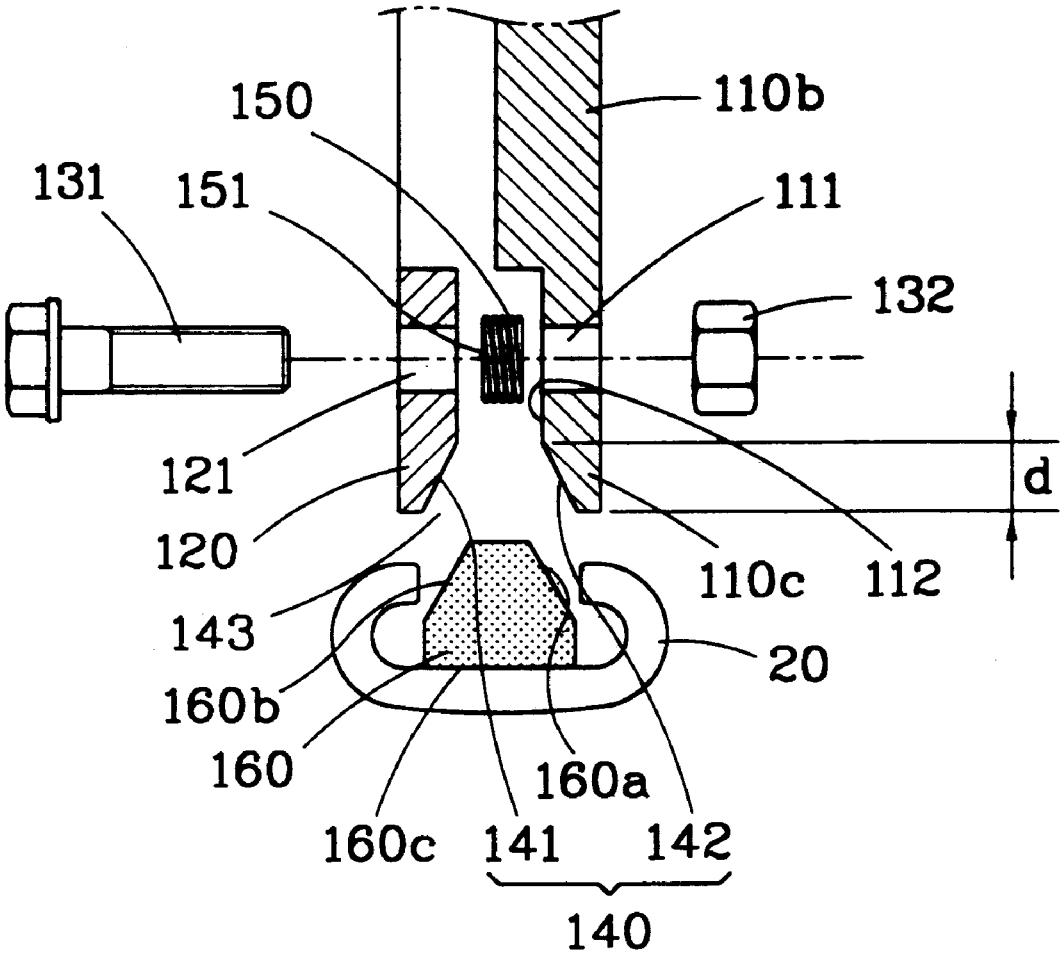
FIG. 11 is a partially enlarged side cross-sectional view similar to that shown in FIG. 7 of another embodiment of the present invention.
Figure 12:
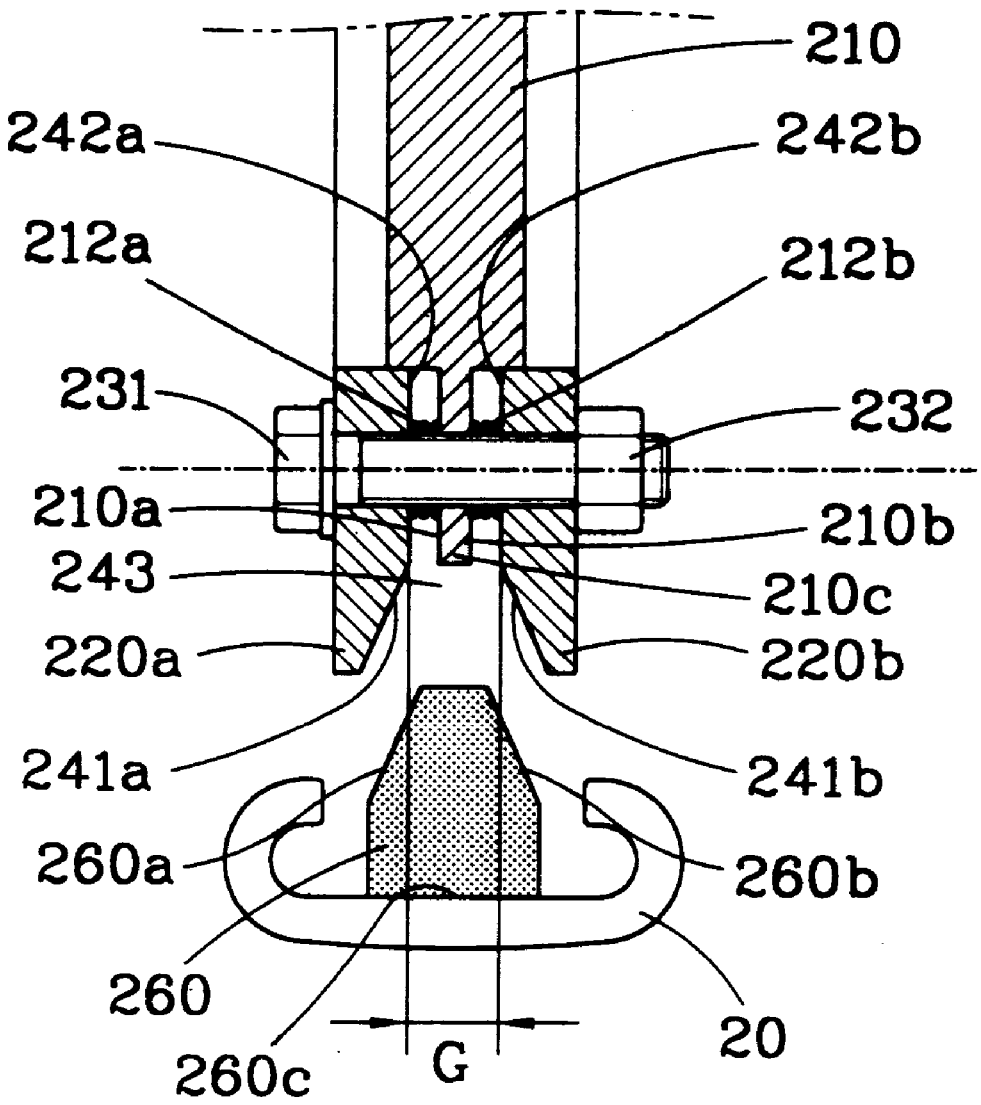
FIG. 12 is a partially enlarged side cross-sectional view similar to that shown in FIG. 9, but of yet another embodiment of the present invention.

The elastic member 150 may be formed of a rubber, a spring (see FIGS. 11 and 12), etc.

A through hole 111, a through hole 151, and a through hole 121 are axially formed at the flange portion 110*c* of the main wheel 110, the elastic member 150 and the driving member 120.

The head portion of the bolt 131 is supported by the upper surface of the movable member 120, and the threaded portion passes through the through holes 121, 151 and 111. The nut 132 is engaged with the threaded portion, so that main wheel 110, the elastic member 150 and the movable member 120 are clamped by the clamping members 131 and 132.

Since the boss portion 110*a* in the main wheel 110 is axially fixed to the driving shaft 51, the elastic member 150 biases the movable member 120 away from the main wheel 110. Therefore, the movable member 120 is spaced-apart from the main wheel 110 or becomes close to the main wheel 110 by adjusting the engagement of clamping members 131 and 132.

The elastic force of the elastic member 150 is zero when the movable member 120 is most spaced-apart from the main wheel 110, and the elastic energy of the elastic member 150 is largest at the position nearest the main wheel 110.

Slant surface 142 of the main wheel 110 and slant surface 141 of the movable member 120 form a groove 143 into which a part of the contact ring 160 is inserted. The contact material 160 is formed of an elastic ring such as a rubber, etc. When the elastic energy is zero, (i.e., when the contact ring 160 is not deflected by an external force), it is desirable for the diameter of the contact ring 160 to be smaller than the main wheel 110.

When moving the movable member 120 towards or away from to the main wheel 110 by controlling the clamping members 131 and 132, the width of the groove 143 changes. Therefore the insertion depth that the contact ring 160 is inserted into the groove 143 changes depending on the width of the groove 143. The contact ring 160 includes a surface inserted into the groove 143 and another surface for applying a friction force for moving the hand rail. The surface of the contact ring 160 inserted into the groove 143 has slant surfaces 160*a* and 160*b* corresponding to slant surface 141 of the movable member 120 and slant surface 142 of the main wheel 110. There is another plane surface 160*c* in the contact ring 160 for providing a friction force for moving the hand rail.

Since slant surfaces 160*a* and 160*b* are inserted into the groove 143 correspondence with slant surfaces 141 and 142 of the movable member 120 and the main wheel 110, the contact ring 160 smoothly into or slides out from the groove 143.

Figure 8A:
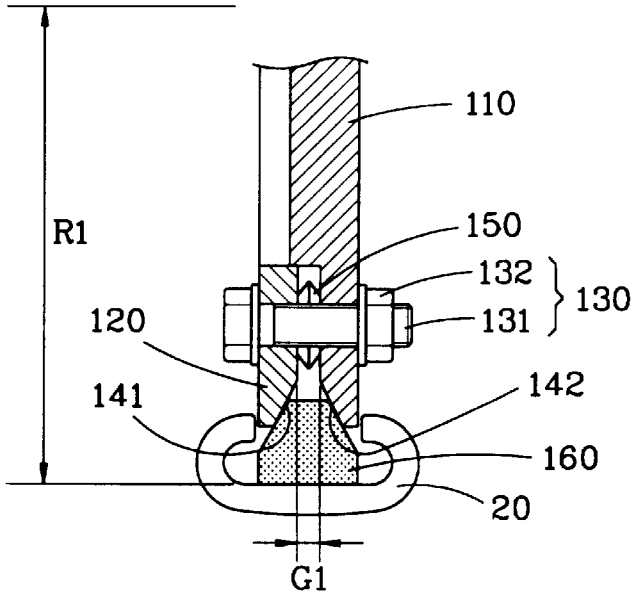
FIG. 8A is a lateral cross-sectional view illustrating a hand rail driving unit in order to explain a state that the radius from the center of a main wheel to an outer surface of a contact ring is decreased by adjusting a movable member to be apart from a main wheel in a hand rail driving pulley unit according to the present invention.
Figure 8B:
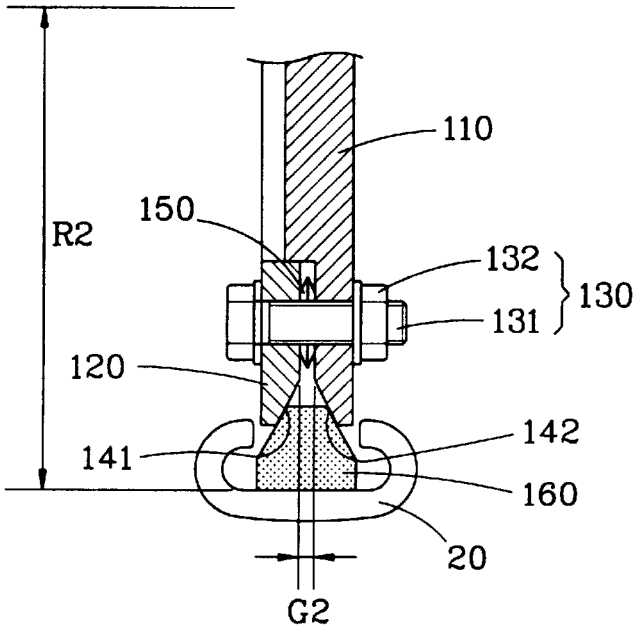
FIG. 8B is a partial lateral cross-sectional view illustrating a hand rail driving pulley unit in order to explain a state that the radius from the center of a main wheel to an outer surface of a contact ring is increased by adjusting a movable member closely to a main wheel in a hand rail driving pulley unit according to the present invention.

FIG. 8A is a lateral cross-sectional view illustrating a hand rail driving pulley unit in order to explain decreasing the radius from the center of a main wheel to an outer surface of a contact ring by adjusting the spacing between movable member 120 and main wheel 110. FIG. 8B is a partial lateral cross sectional view illustrates increasing the radius from the center of a main wheel to an outer surface of a contact ring by adjusting the spacing between movable member 120 and main wheel 110 to become close.

Referring to FIG. 8A and FIG. 8B, the operation and effects of the speed control of the hand rail according to the present invention will be explained.

When moving the movable member 120 away from the main wheel 110 by controlling the clamping units 131 and 132, the width of the groove 143 increases, and the depth that the contact ring 160 slides into the groove 140 increases. As the depth that the contact ring 160 slides into the groove 140 increases, the radius from the rotation center of the main wheel 110 to the plane surface 160*c* of the contact ring 160 contacting with the hand rail 20, (i.e., the rotation radius of the hand rail driving unit R1) decreases.

The above-described state is shown in FIG. 8A. At this time, the length of the elastic member 150 is G1. In this state, since the friction force between the contact ring 160 and the hand rail 20 is decreased, the moving speed of the hand rail 20 thus becomes slower.

When moving the movable member 120 towards the main wheel 110 by adjusting the clamping units 131 and 132, the width of the groove 143 decreases, and the depth that the contact ring 160 slides into the groove 143 decreases. As the depth that the contact ring 160 slides into the groove 143 decreases, the radius from the rotation center of the main wheel 110 to the plane 160*c* of the contact ring 160 contacting with the hand rail 20, (i.e., the rotation radius of the hand rail driving pulley unit) increases. The above-described state is shown in FIG. 8B. At this time, the length of the elastic member 150 is G2. In this state, since the friction force between the contact ring 160 and the hand rail 20 is increased, the moving speed of the hand rail 20 is increased.

Figure 9:
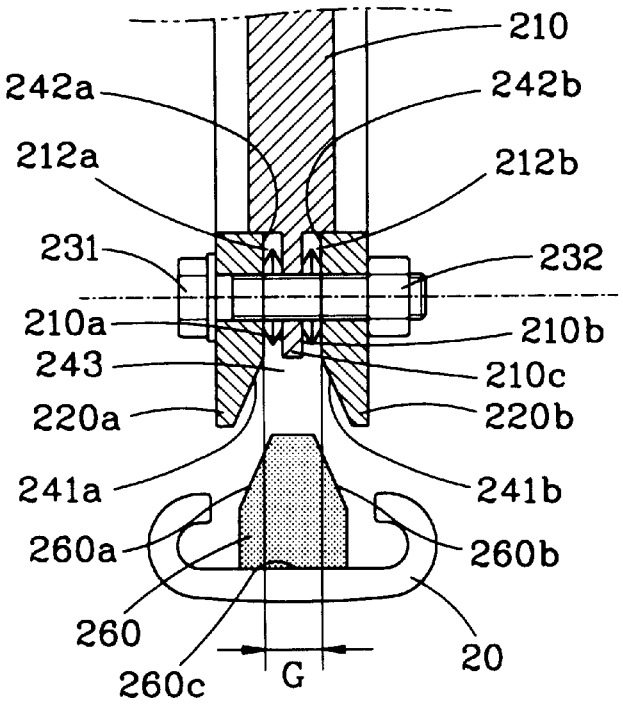
FIG. 9 is a partial lateral cross-sectional view illustrating a hand rail driving pulley unit according to another embodiment of the present invention.

FIG. 9 is a partial lateral cross-sectional view illustrating the hand rail driving pulley unit according to another embodiment of the present invention.

The main wheel 210 includes a flange portion 210*a* stepped down from the outer end portion, a boss portion(not shown) axially fixed to the driving shaft 51 for drivingly coupling the main wheel 210 and the driving shaft 51, and three spoke portions(not shown) radially extending from the boss portion for connecting the flange portion 210*a* and the boss portion.

The flange portion 210*a* includes planes 210*b* and 210*c* which are opposite to flat surfaces 242*a* and 242*b* of the movable members 220*a* and 220*b*.

A pair of axially movable members 220*a* and 220*b* are disposed between a position spaced-apart from the planes 242*a* and 242*b* of the flange portion 210*a* and the position proximate to the planes 242*a* and 242*b*. The movable member 220*a* has a plane 242*a* and a slant surface 241*a*, and the movable member 220*b* has a plane 242*b* and a slant surface 241*b*.

A elastic member 212*a* is disposed between the plane 242*a* of the movable member 220*a* and the plane 210*b* of the flange portion 210*a*, and another elastic member 212*b* is disposed between the plane 242*b* of the driving member 220*b* and the plane 210*c* of the flange portion 210*a*, The main wheel 210 is installed on the driving shaft 51 fixedly in the axial direction so that the center portion of the boss portion passes through the driving shaft 51. Therefore, the elastic member 212*a* provides an elastic force so that the movable member 220*a* is biased away from the plane 210*b* of the flange portion 210*a*, and the elastic member provides an elastic force so that the movable member 220*b* is biased away from the plane 210*c* of the flange portion 210*a*.

Shaft holes are formed in the movable members 220*a* and 220*b*, the flange portion 210*a*, and the elastic members 212*a* and 212*b*. The clamping units 231 and 232 are installed for variably adjusting the movable members 220*a* and 220*b* between a position spaced-apart from the planes 242*a* and 242*b* of the flange 210*a* and a position proximate to the planes 242*a* and 242*b* with respect to the flange portion 210*a* and for maintaining the adjusted position by clamping the movable members 220*a* and 220*b*, the flange portion 210*a*, and the elastic members 212*a* and 212*b*. The clamping units 231 and 232 each include a bolt 231 having its head portion supported by the movable member 220*a* and passing through the shaft hole, and a nut 232 engaged with the threaded portion formed on the bolt 231 passing through the shaft hole.

Therefore, the movable members 220*a* and 220*b* are axially movable by adjusting the clamping units 231 and 232.

The elastic force of the elastic members 212*a* and 212*b*, is zero when the movable members 220*a* and 220*b* are most spaced-apart from the main wheel 110, and the elastic energy of the elastic members 212*a* and 212*b* is largest when the movable members 220*a* and 220*b* are nearest the main wheel 210.

Slant surfaces 241*a* and 241*b* of the movable members 220*a* and 220*b* define a groove 243 into which a part of the contact ring 260 is inserted. The contact ring 260 is made of an elastic member such as a rubber. When the elastic energy is zero, (i.e., when the contact ring 260 is not extended), the radius of the contact ring 260 is smaller than the radius which is obtained by adding the radius from the center of the main wheel 210 and the distance to the outer diameter of the movable members 220*a* and 220*b*.

When moving the movable members 220*a* and 220*b*, the width of the groove 243 changes, and the depth that the contact ring 260 is inserted into the groove 243 changes depending on the width of the groove 243.

The contact ring 260 includes a surface inserted into the groove 243 and another surface contacting the hand rail 20, thereby generating a friction force for moving the hand rail 20. The surface of the contact ring 160 inserted into the groove 243 includes slant surfaces 260*a* and 260*b* corresponding with slant surfaces 241*a* and 241*b* of the movable members 220*a* and 220*b*, and another surface by which a friction force is generated for moving the hand rail is a plane 260*c*.

Slant surfaces 260*a* and 260*b* of the contact ring 260 inserted into the groove 243 and the opposite slant surfaces 241*a* and 241*b* of the movable members 220*a* and 220*b* are formed correspondingly with one another, so that the contact ring 260 smoothly and quickly slides radially into or out from the groove 243.

When moving the movable members 220*a* and 220*b* by adjusting the clamping units 231 and 232, the width of the groove 243 increases, so that the depth that the contact ring 260 slides into the groove 243 increases. When the depth that the contact ring 260 slides into the groove 243 increases, the radius from the rotation center of the main wheel 210 to the plane 260*c* of the contact ring 260 contacting with the hand rail 20, (namely, the rotation radius of the hand rail driving wheel unit) decreases. In this state, since the friction force between the contact ring 260 and the hand rail 20 is decreased, the moving speed of the hand rail 20 will be slower.

When moving the movable members 220*a* and 220*b* to the main wheel 210 by adjusting the clamping units 231 and 232, the width of the groove 243 decreases, so that the depth that the contact ring 260 slides into the groove 243 is decreases.

Therefore, the radius from the rotation center of the main wheel 210 to the plane 260*c* of the contact ring 260 contacting with the hand rail 20, (namely, the rotation radius of the hand rail driving wheel unit) increases. In this state, since the friction force between the contact ring 260 and the hand rail 20 increases, the moving speed of the hand rail 20 will be faster.

Figure 10:
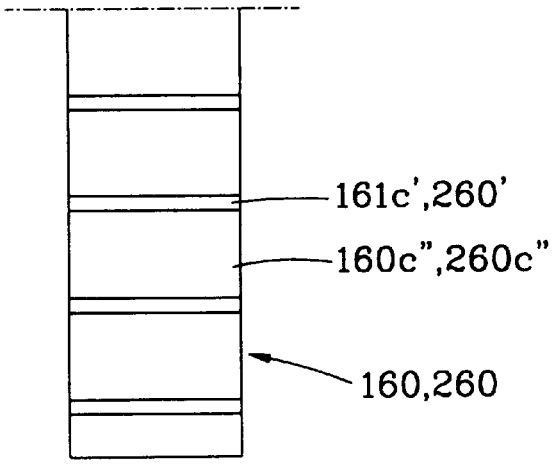
FIG. 10 is a partial lateral cross-sectional view illustrating a contact ring according to the present invention.

FIG. 10 is a partial lateral view illustrating a contact ring according to the present invention. The construction and operation of the contact ring according to the present invention will be explained with reference to FIG. 10.

As shown in FIGS. 8A, 8B and 9, in the contact ring according to one and another embodiment of the present invention, the contact rings 160 and 260 each preferably include concave portions 160*c*', 260*c*' and convex portions 160*c*" and 260*c*". The concave portions 160*c*' and 260*c*' and the convex portions 160" and 260*c*" increase the friction force between the contact rings 160 and 260 and the hand rail 20.

The procedure for changing the contact rings according to the present invention will be explained.

In a state that the contact rings 160 and 260 are inserted into the grooves 143 or 243 by a shallow depth by adjusting the clamping unit when exchanging the contact rings 160 and 260, a part of the contact rings 160 and 260 is manually pulled, the contact rings 160 and 260 made of an elastic material such as a rubber are extended, so that the contact rings 160 and 260 are separated from the groove 143 or 243. Thereafter, the remaining parts of the contact rings 160 and 260 are removed. When inserting new contact rings 160 and 260, parts of the contact rings 160 and 260 are inserted into an upper portion among the surrounding portions of the groove 143 or 243, and parts of the contact rings 160 and 260 are manually pulled, so that the contact rings 160 and 260 are extended for thereby exchanging the same.

As described above, in the present invention, it is possible to compensate for the speed difference by providing a passenger conveyer including a hand rail driving pulley unit without exchanging the parts when a speed difference occurs between the hand rail and step, so that the maintenance cost and time are significantly decreased compared to the conventional art.

In addition, the passenger conveyer including a hand rail driving pulley unit according to the present invention is implemented by inserting the contact ring contacting with the hand rail based on an inventive insertion method. When the contact ring is worn, the worn contact ring is easily exchanged with a new one, so that the contact ring exchanging cost and time is easily implemented.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A passenger conveyor comprising:

a driving motor for generating a driving torque;

a rotatable driving sprocket operatively engaged with said driving motor so as to be rotated thereby;

a rotatable driven sprocket;

an end less loop step chain engaged with both said driving sprocket and said driven sprocket;

a plurality of steps for providing a surface for a passenger to step upon, said plurality of steps being coupled with said step chain so as to be moved thereby;

first and second sidewalls provided at respective lateral sides of said plurality of steps;

first and second handrails provided about peripheries of said first and second sidewalls, respectively, said first and second handrails being moveable along said peripheries of said first and second sidewalls, respectively, in the same direction as said plurality of steps; and first and second rotatable handrail driving pulley assemblies each operatively engaged with said driving sprocket so as to be rotated in the same direction thereby, said first and second handrail driving pulley assemblies providing a driving force to said first and second handrails, respectively, each said handrail driving pulley assembly being radially adjustable for controlling a driving speed of said first and second handrails.

2. The passenger conveyor of claim 1, wherein said handrail driving pulling assemblies each comprise:

a driving shaft operatively coupled with said driving sprocket;

a rotatable main wheel mounted on said driving shaft;

at least one moveable member provided adjacent a peripheral edge of said main wheel opposite an axial surface of said main wheel, said at least one moveable member being mounted relative to said main wheel so as to be moveable in an axial direction towards and away from said axial surface of said main wheel, a peripheral edge of said at least one moveable member and a peripheral edge of said main wheel defining a groove of variable axial width therebetween; and a handrail contact ring disposed in said groove defined between said peripheral edge of said at least one moveable member and said peripheral edge of said main wheel, a radial position of said contact ring in said groove being related to said axial width of said groove, said contact ring including a friction surface contacting a respective said handrail for driving said respective handrail.

3. The passenger conveyor according to claim 2, wherein said handrail driving pulley assemblies each further comprise an elastic member between said main wheel and said at least one moveable member for resiliently biasing said moveable member away from said main wheel.

4. The passenger conveyor according to claim 2, wherein said handrail driving pulley assemblies each further comprise a clamping assembly for fixing an axial position of said moveable member relative to said main wheel.

5. The passenger conveyor according to claim 4, wherein said clamping assembly comprises a nut and bolt engaging said main wheel and said moveable member.

6. The passenger conveyor according to claim 3, wherein said elastic member is made from a resilient rubber.

7. The passenger conveyor according to claim 3, wherein said elastic member is a spring.

8. The passenger conveyor of claim 2, wherein said at least one moveable member and said main wheel each include opposing inclined surfaces defining sidewalls of said groove.

9. The passenger conveyor of claim 8, wherein said contact ring includes inclined surfaces on a radially inward side thereof shaped to cooperate with said inclined surfaces of said at least one moveable member and said main wheel.

10. The passenger conveyor of claim 2, wherein said at least one moveable member is a continuous ring-shaped member.

11. The passenger conveyor of claim 2, wherein said friction surface includes at least one protruding rib portion for enhancing a friction force between said contact ring and a respective said handrail.

12. The passenger conveyor of claim 1, wherein said handrail driving pulling assemblies each comprise:

a driving shaft operatively coupled with said driving sprocket;

a rotatable main wheel mounted on said driving shaft;

two moveable members provided adjacent a peripheral edge of said main wheel opposite to oppositely facing axial surfaces of said main wheel, respectively, each said moveable member being mounted relative to said main wheel so as to be moveable in an axial direction towards and away from said respective oppositely facing axial surfaces of said main wheel, respective peripheral edges of said moveable members defining a groove of variable axial width therebetween; and a handrail contact ring disposed in said groove defined between said peripheral edges of said moveable members, a radial position of said contact ring in said groove being related to said axial width of said groove, said contact ring including a friction surface contacting a respective said handrail for driving said respective handrail.

13. The passenger conveyor according to claim 12, wherein said handrail driving pulley assemblies each further comprise elastic members disposed between said respective oppositely facing axial surfaces of said main wheel and said respective moveable members for resiliently biasing said moveable members away from said main wheel.

14. The passenger conveyor according to claim 12, wherein said handrail driving pulley assemblies each further comprise a clamping assembly for fixing an axial position of said moveable members relative to said main wheel.

15. The passenger conveyor according to claim 14, wherein said clamping assembly comprises a nut and bolt engaging said main wheel and said moveable members.

16. The passenger conveyor according to claim 13, wherein at least one said elastic member is made from a resilient rubber.

17. The passenger conveyor according to claim 13, wherein at least one said elastic member is a spring.

18. The passenger conveyor of claim 12, wherein said moveable members each include opposing inclined surfaces defining sidewalls of said groove.

19. The passenger conveyor of claim 18, wherein said contact ring includes inclined surfaces on a radially inward side thereof shaped to cooperate with said inclined surfaces of said at least one moveable member and said main wheel.

20. The passenger conveyor of claim 12, wherein said moveable members are each a continuous ring-shaped member.

21. The passenger conveyor of claim 12, wherein said friction surface includes at least one protruding rib portion for enhancing a friction force between said contact ring and a respective said handrail.

22. A driving pulley assembly for driving a handrail of a passenger conveyor, comprising:

a driving shaft adapted to be coupled with a drive source;

a rotatable main wheel mounted on said driving shaft;

at least one moveable member provided adjacent a peripheral edge of said main wheel opposite an axial surface of said main wheel, said at least one moveable member being mounted relative to said main wheel so as to be moveable in an axial direction towards and away from said axial surface of said main wheel, a peripheral edge of said at least one moveable member and a peripheral edge of said main wheel defining a groove of variable axial width therebetween; and a handrail contact ring disposed in said groove defined between said peripheral edge of said at least one moveable member and said peripheral edge of said main wheel, a radial position of said contact ring in said groove being related to said axial width of said groove, said contact ring including a friction surface contacting a respective said handrail for driving said respective handrail.

23. A driving pulley assembly for driving a handrail of a passenger conveyor, comprising:

a driving shaft operatively coupled with said driving sprocket;

a rotatable main wheel mounted on said driving shaft;

two moveable members provided adjacent a peripheral edge of said main wheel opposite to oppositely facing axial surfaces of said main wheel, respectively, each said moveable member being mounted relative to said main wheel so as to be moveable in an axial direction towards and away from said respective oppositely facing axial surfaces of said main wheel, respective peripheral edges of said moveable members defining a groove of variable axial width therebetween; and a handrail contact ring disposed in said groove defined between said peripheral edges of said moveable members, a radial position of said contact ring in said groove being related to said axial width of said groove, said contact ring including a friction surface contacting a respective said handrail for driving said respective handrail.

* * * * *